United States Patent [19]

Petterson

[11] 3,990,758

[45] Nov. 9, 1976

[54] CHILD-SAFE ELECTRICAL OUTLET

[76] Inventor: Tor H. Petterson, 312-48 Palos Verdes Drive West, Palos Verdes Peninsula, Calif. 90274

[22] Filed: May 6, 1974

[21] Appl. No.: 467,295

[52] U.S. Cl. ..... 339/43
[51] Int. Cl.[2] ..... H01R 13/44
[58] Field of Search ..... 339/40–44, 339/94, 36; 174/67

[56] References Cited

UNITED STATES PATENTS

| | | | |
|---|---|---|---|
| 2,155,925 | 4/1939 | Blinn | 339/43 |
| 2,279,516 | 4/1942 | O'Brien | 339/40 |
| 3,096,132 | 7/1963 | Hubbell | 339/36 |

FOREIGN PATENTS OR APPLICATIONS

| | | | |
|---|---|---|---|
| 658,827 | 3/1938 | Germany | 339/42 |
| 1,011,956 | 7/1957 | Germany | 339/43 |
| 648,241 | 10/1962 | Italy | 339/40 |
| 1,210,359 | 10/1970 | United Kingdom | 339/40 |
| 1,184,250 | 3/1970 | United Kingdom | 339/36 |

*Primary Examiner*—Joseph H. McGlynn
*Assistant Examiner*—Craig R. Feinberg
*Attorney, Agent, or Firm*—A. W. Breiner

[57] ABSTRACT

Disclosed herein is a safety outlet which may be readily interchanged for a standard electrical outlet and which has a unique safety feature for preventing insertion of a foreign object into one of the slots in the outlet thereby preventing electrical shock. This safety feature is obtained at low cost and is particularly suited for high speed assembly. The safety also provides improved plug/prong engagement.

14 Claims, 28 Drawing Figures

CHILD-SAFE ELECTRICAL OUTLET

Electrical power is transmitted from its source to its point of use through a distribution system wherein the equipment used and operations conducted are designed and operated with human safety as a primary consideration. Yet, when that same electrical energy is delivered for use to a residence, it appears that the concern for human safety is no longer paramount. For example:

1. The electric outlets now in common use include a pair of slots for receiving the prongs of an electric plug, these prongs directly engage contacts in the outlet in line with the slots thereof to make the desired electrical connection. Since a large percentage of these outlets are used in homes where they are usually located near the floor, a young child can insert small flat articles into the slots, and if a child does this with a metal article, an electrical shock will result or a young child may place a portable outlet in its mouth and produce a burn or shock when its saliva reaches the electrical contact. As can be appreciated either is very dangerous.

2. Improper or loose insertion of an electrical plug in a standard outlet can cause a dangerous arcing of electrical current from the plug prongs to the outlet resulting in a burned face plate or fire or possible injury to the user. The connection between the plug prongs and the outlet contact oftentimes is not ideal, thus, standard plugs are easily pulled from a conventional electrical outlet or can otherwise be easily disconnected resulting in unintentional breaking of the electrical circuit supplying current to an electrical device. Repeatedly reinserting such a "loose" plug can be both time consuming and annoying.

3. The contacts of electrical outlets oftentimes are contaminated with dust, moisture and other contaminants which enter the outlet through the slots provided for the plug prongs. Additionally, the plug prongs themselves are often contaminated with dust and/or corrosion. These contaminants either on the contacts and/or on the prongs can interfere with proper electrical engagement and/or cause arcing. Moreover, outlets which are capable of maintaining the slots in a "closed" position are substantially more expensive than conventional outlets commercially available.

A number of attempts have been made to produce an outlet having safety features which would avoid the various hazards described above. However, all of the attempts heretofore have resulted in devices having certain drawbacks. Foremost among these drawbacks is one of expense. That is, there is extensive prior art describing various outlets with safety features, however, the added expense required to manufacture such outlets outweighs the safety advantage. This is evidenced by the fact that a suitable safety outlet has not been marketed in high volume successfully to date.

The prior art discloses wall receptacles that incorporate switch means which activate the receptacles and allow entrance of specially constructed plugs, part of the receptacles and plugs being rotated to lock the special plugs therein. This is taught by U.S. Pat. Nos. 1,700,437 and 3,066,276. U.S. Pat. Nos. 3,543,218 and 2,733,416, disclose a receptacle and plug maintaining device, each havng locking means to lock an electrical plug therein. Other safety devices are disclosed in U.S. Pat. Nos. 2,477,803, 2,540,496, and 2,826,652.

The purpose of the present invention is to provide a low cost, electrical outlet designed with safety as a prime consideration and which is compatible with standard electrical plugs and capable of being installed within existing electrical outlet boxes, whererin obtaining the various safety features does not require any manipulative steps other than inserting the plug.

A main object of the present invention is to provide both fixed and portable electrical outlets, designed to avoid shock when an electrically conductive object is inserted into one of its slots or the outlet is put into the mouth.

Another object is to provide an outlet having a prong/contact arrangement which ensures a firm and positive engagement between the prongs of the plug and the contacts of the outlet while also providing a wiping of the plug prongs prior to engagement with the contacts.

Another object is to provide a safety outlet wherein the plug can be inserted directly without any additional manipulative steps and the safety means is so constructed that it will function reliably over the life of the outlet.

A salient object of my invention is to provide an electrical outlet wherein the electrical contact devices thereof will automatically be effectively shielded or protected from engagement with foreign and/or improper objects.

It is also an object of the invention to provide an electrical outlet constructed so that the electrical contacts are protected from the accumulation of contaminants, such as, dirt, moisture and the like; thus, insuring they are maintained in a preferred operating condition over a prolonged period of time, and alternatively with minor modifications to provide an outlet that is water proof.

A further object of the invention is to provide an electrical outlet which is durable yet simple to construct and which is capable of being manufactured at high volume and low cost.

Yet another object of the invention resides in the provision of a fixed electrical outlet, so designed and constructed that it can be installed and used in substantially the same manner as conventional standard types of electrical outlets heretofore prevalent in the art.

Another object of the invention is to provide an electrical outlet with an improved safety feature, while also providing a means for reducing causes of arcing.

Yet another object of the invention is to provide an improved method of fabricating and assembling an electrical outlet which results in safety features heretofore unavailable at a relatively small incremental increase in cost.

It will be apparent to those skilled in the art that the novel safety outlet herein described achieves all the objectives set forth above. Furthermore, it will be apparent that these objectives are achieved with a minimum of complexity and with inexpensive parts. All parts of the mechanism of this invention may be easily and cheaply manufactured out of any suitable material, such as plastic. Furthermore, there are only three moving parts, so that the device is reliable, rugged and inexpensive, while still providing maximum safety and performance in its intended application.

It will also be observed that only one motion is required to engage the plug with the outlet. In other words, by merely inserting the plug directly into the slots of the outlet, the safety means of the invention is disengaged and electrical contact is made. Previous constructions have been provided with slideable or rotatable doors interposed between the contact members. These doors have to be actuated by one or more motions before it is possible to insert the plug therein. In the present construction, the plug is inserted in its normal manner by a direct thrust into the slots and no other manipulative movement is required for the prongs to engage the contacts.

An outlet so constructed as to embody the invention may take many different structural forms, but stated generally, each such form will include interdependent shutters associated with the slots of the outlet. These shutters are so constructed and arranged as to be moved simultaneously inward by the entrance of the plug prongs. However, if an object is pushed into only one of the slots and thus engages only one of the shutters a locking effect results which prevents engagement of the object with the electrical contact. In addition, when the plug prongs are pushed into the slots simultaneously, they are wiped by the shutters prior to engaging the contacts of the outlet.

The new outlet of the invention is superior to prior safety outlets in that it may be employed with any standard type of plug and the prongs of the plug may be inserted in the slots to engage the contacts by means of a single straight line movement. Also, the safety means of the outlet are made up of a relatively few parts, of which the principal ones are so constructed that they can be readily produced at little expense by high speed molding operations. Because sufficiently of its simplicity, the safety outlet of the invention can be easily assembled at high speed resulting in a low manufacturing cost.

Standard wall outlets and portable outlets have electrical contact means in the form of metal clips which are positioned inward from the slots to receive the prongs of the plug, so that the prongs will be engaged. The National Electrical Manufacturers Association has established standard dimensions for plugs and wall outlets, and these standards have been published by the American Standards Association in order to permit complete interchangeability of plugs and outlets produced by different manufacturers. For example, a cover plate, to be useable with an American Standard plug cannot exceed about 1/8 inch. If the thickness of material over the outlet exceeds 1/8 inch, the prong of the plug cannot extend into the spring clips of the outlet sufficiently to be gripped by such clips so as to retain the plug in the outlet. The safety outlet of this invention not only meets these standards, but if the plug and cover plate comply with these standards the outlet provides a means of assuring optimum engagement between the contact and the plug prongs.

In the accompanying drawings forming a part of this application:

Figure 4:
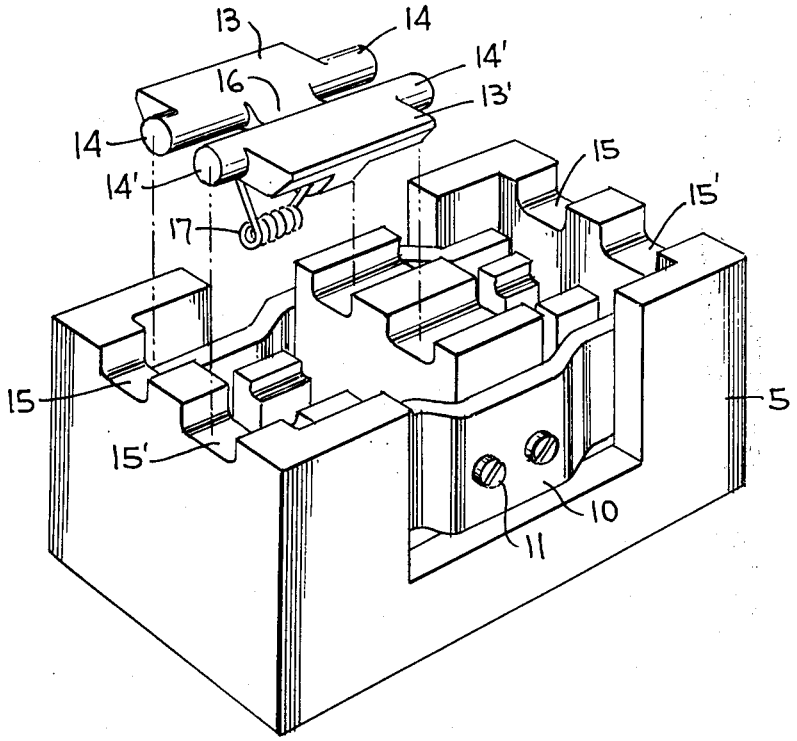
FIG. 4 is an exploded perspective view of the outlet lower housing illustrating the bearing support means and the relation of the lower housing to the shutter means and further illustrating the pre-assembly of the synchronizer means to the shutter means.
Figure 3:
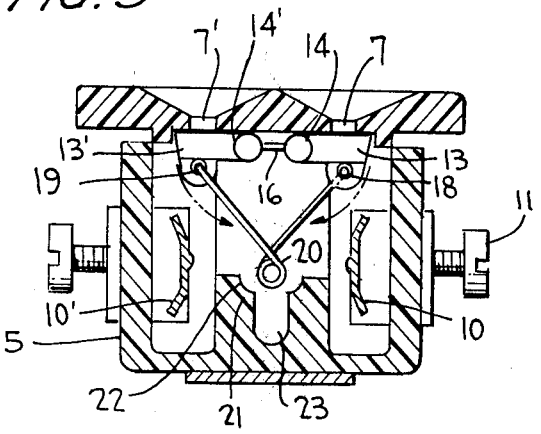
FIG. 3 is a sectional view along section 3 — 3 in FIG. 2 showing the outlet before it has been activated for the first time with the shutter means in the normally closed position and illustrating the post assembly, break joint means intact.
Figure 5:
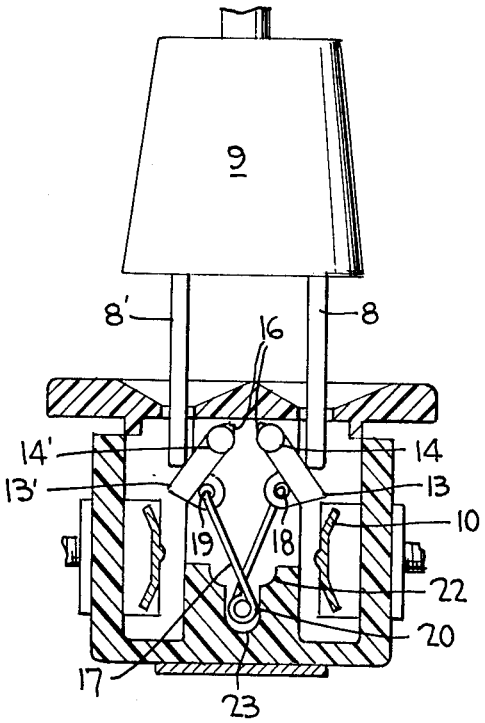
FIG. 5 is a sectional view along the line 5 — 5 of FIG. 2 illustrating the plug partially withdrawn from the outlet and illustrating the arc depressing and wiping features of the shutters means.
Figure 10:
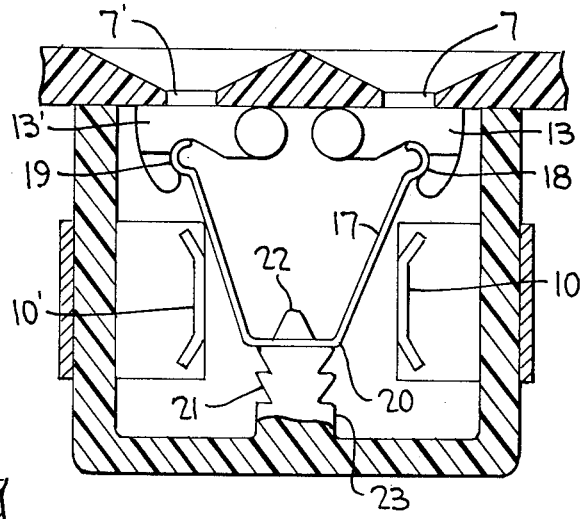
Figure 11:
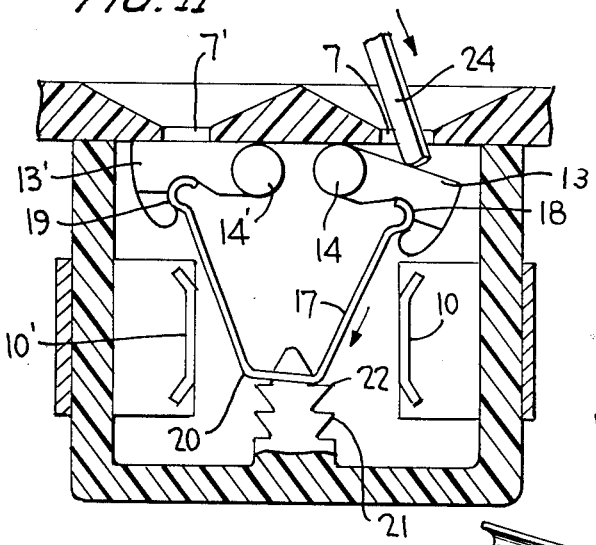
Figure 12:
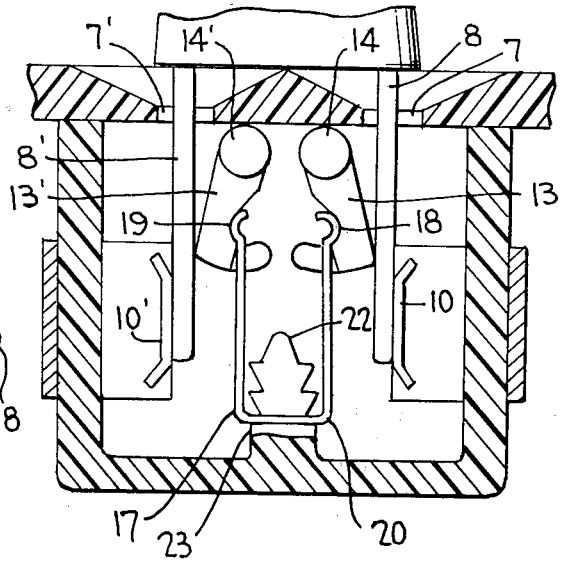

FIGS. 10, 11, and 12 are similar to FIGS. 3, 4, and 5 respectively illustrating alternative synchronizer and lock means embodiments.

Figure 13:
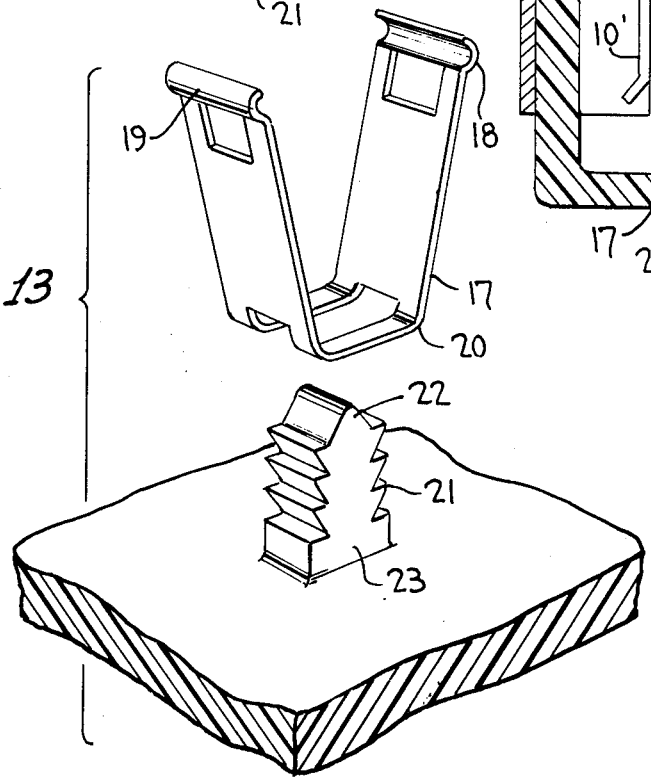

FIG. 13 is a perspective drawing of a metal stamp spring, synchronizer and a post lock embodiment.

Figure 14:
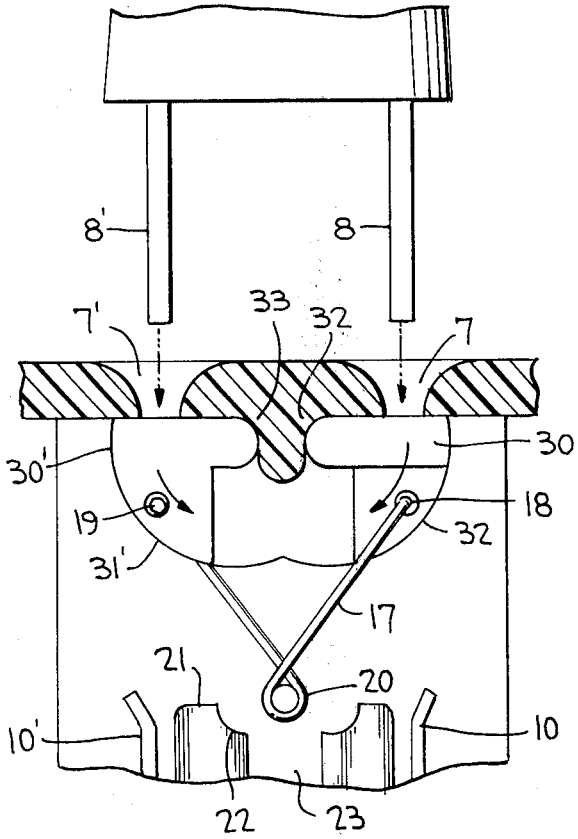

FIG. 14 is a perspective view of an alternative shutter means.

Figure 15:
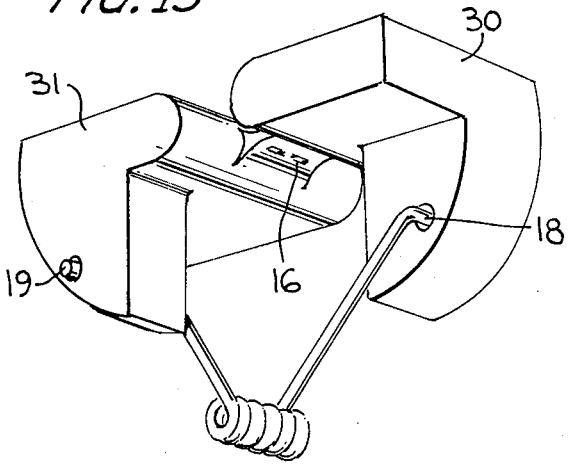

FIG. 15 is a perspective view of an alternative shutter means.

Figure 6:
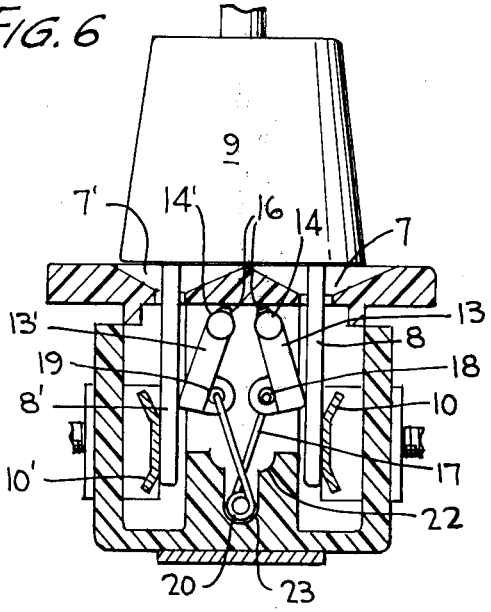
FIG. 6 is a sectional view along sectional line 5 — 5 in FIG. 2 showing the plug prongs in engagement with the electrical contacts with the shutters in the open position; and the relation of the lock pall to the lock travel means.
Figure 8:
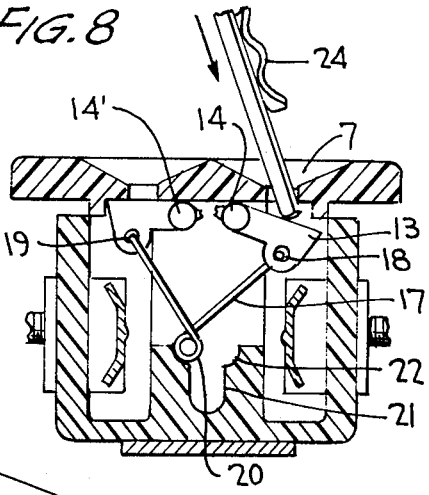
FIG. 8 is similar to FIG. 3 and illustrates the actuation of the lock means by inserting a foreign object into one slot of the outlet.
Figure 16:
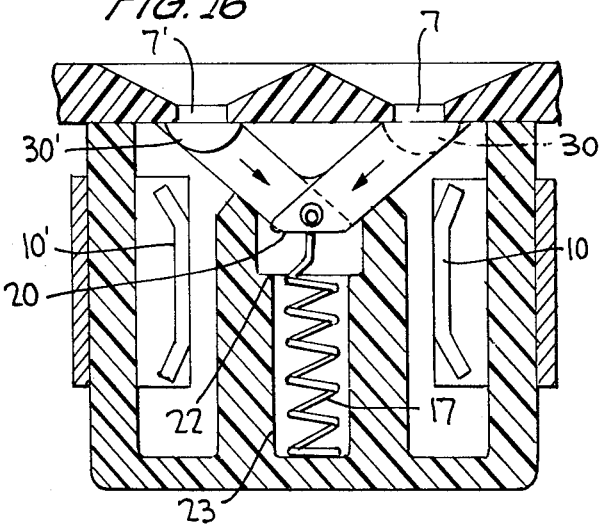
Figure 17:
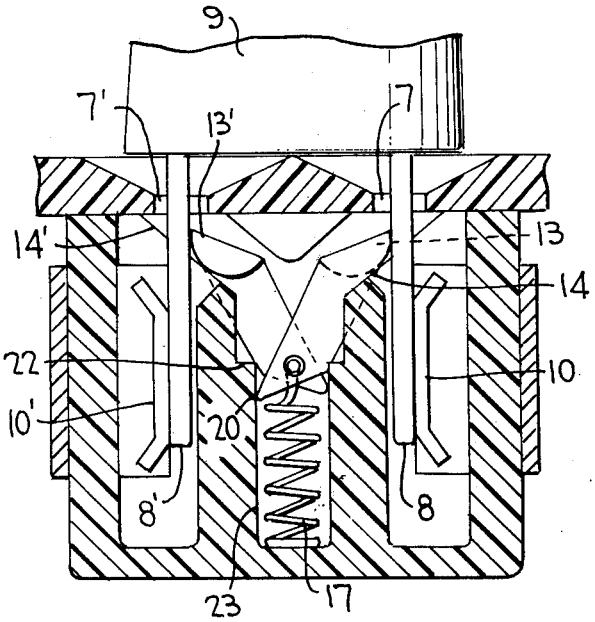
Figure 18:
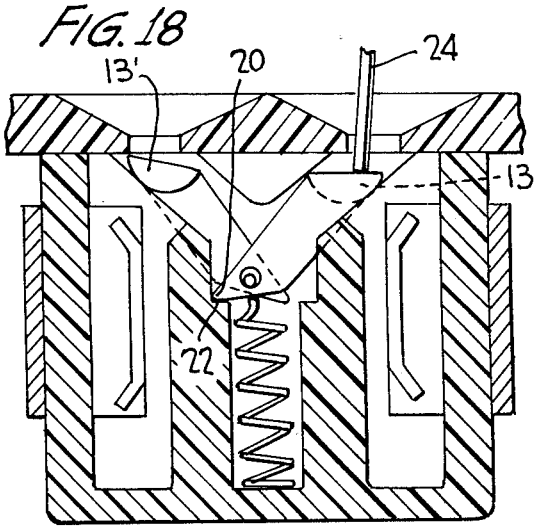

FIGS. 16, 17, and 18 are similar to the views of FIGS. 3, 6, and 8 of an alternative shutter means.

Figure 19:
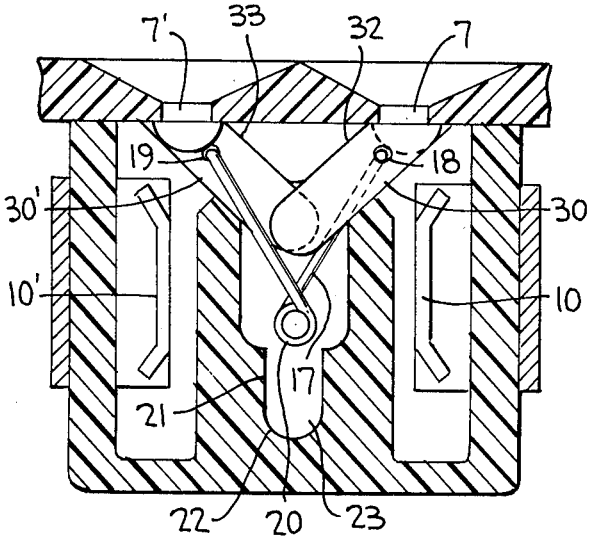
Figure 20:
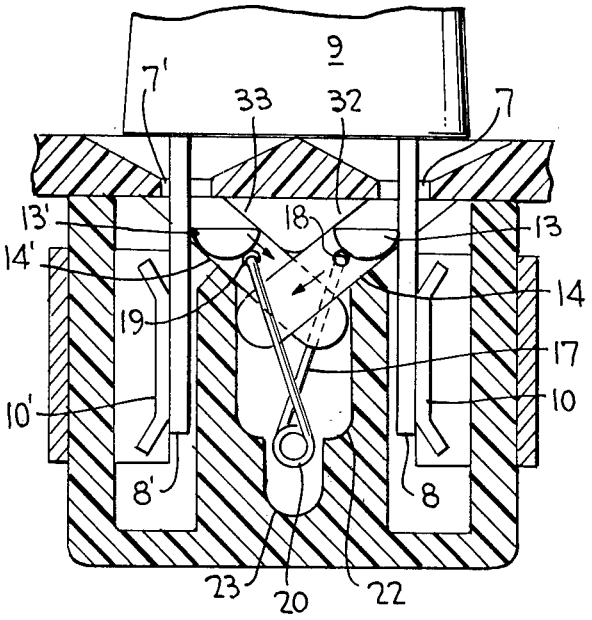

FIGS. 19 and 20 are sectional views similar to FIGS. 3 and 6 respectively illustrating alternative shutter and positioning means.

Figure 21:
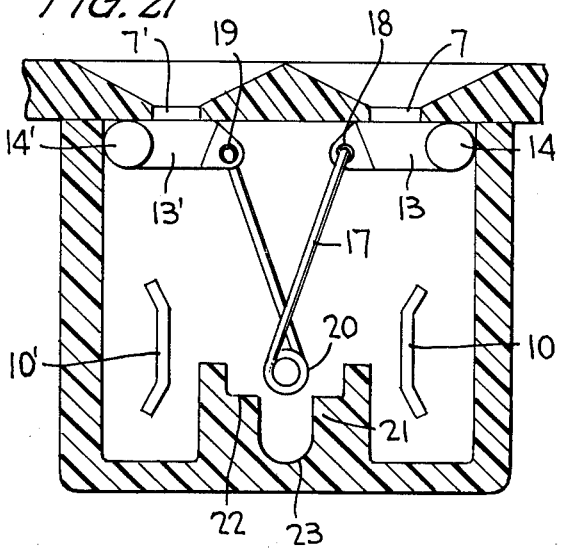
Figure 22:
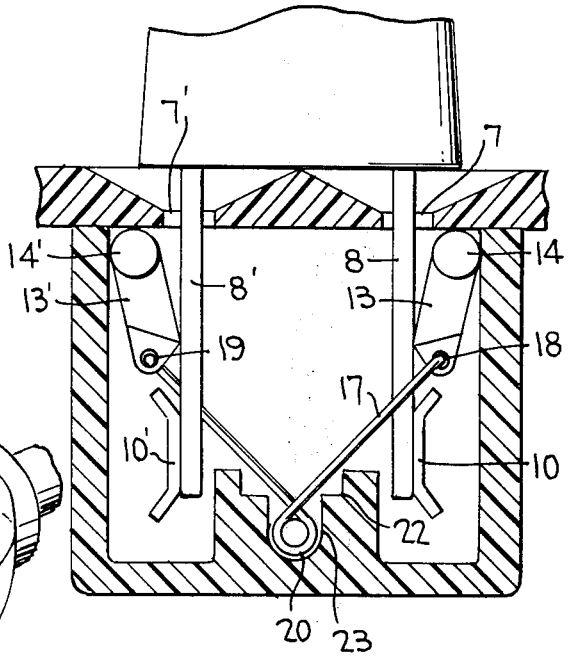

FIGS. 21 and 22 are sectional views similar to FIGS. 3 and 6 respectively illustrating alternative positioning means and alternative shutter means for wiping the prongs.

Figure 23:
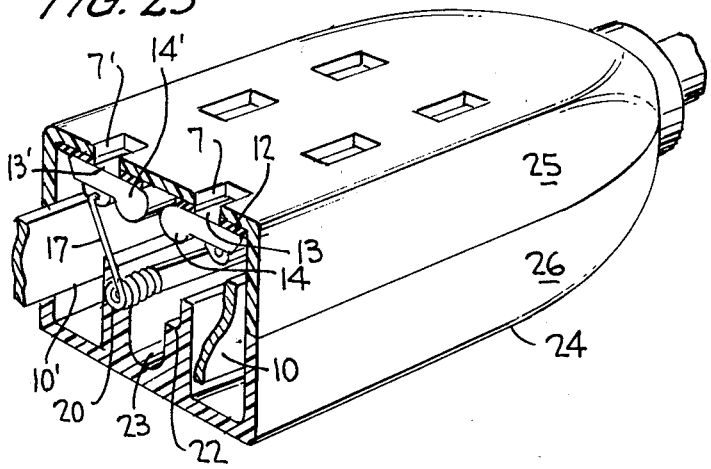

FIG. 23 is a partial sectional view illustrating the safety features of the invention in a portable service cord.

Figure 24:
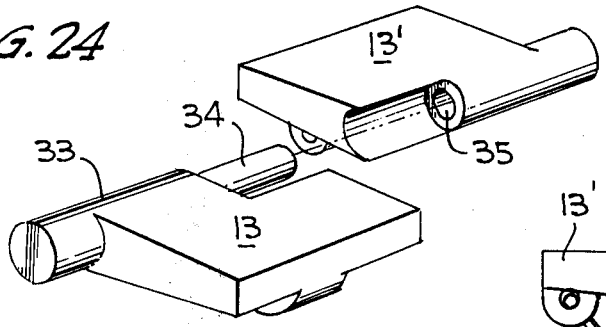
Figure 25:
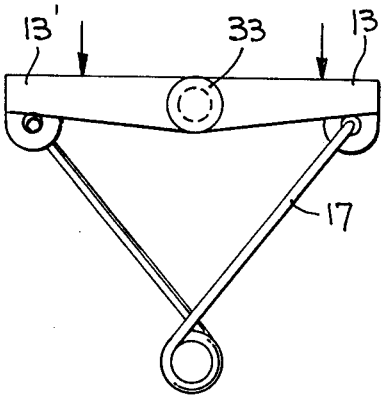

FIGS. 24 and 25 are perspective views of an alternative shutter positioning means.

Figure 26:
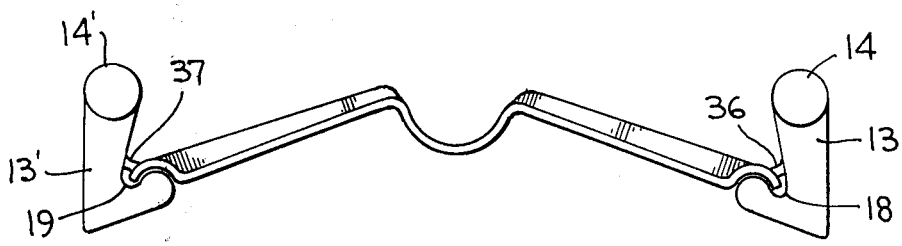
Figure 27:
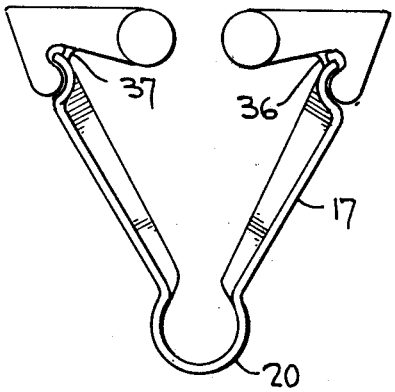
Figure 28:
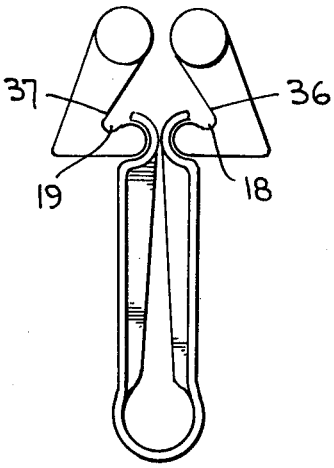

FIGS. 26, 27, and 28 are perspective views of a one-piece assembly with an alternative post assembly break joint. For purposes of illustration this invention is described with reference to a conventional household outlet having two receptacles for plugs. However, it will be appreciated that the safety feature of the invention can also be used with outlets which are not permanently secured. For example, branching plugs and portable outlets such as extension cords can also be improved by the present invention as shown in FIG. 23.

Figure 1:
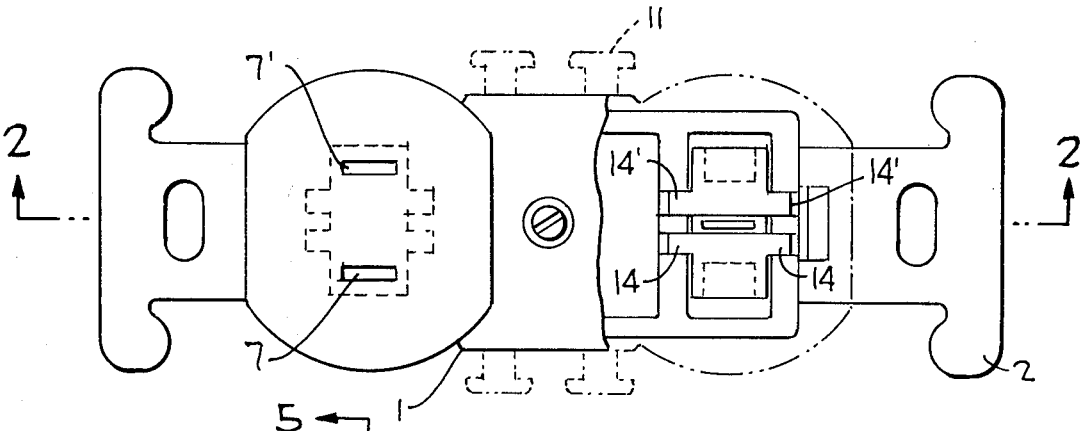
FIG. 1 is a plan partial sectional view of a completely assembled duplex, electrical outlet comprising this invention.

Referring to FIG. 1, the duplex electrical outlet indicated generally by 1, is provided with a bracket 2 for securing in place in any suitable container in a wall or floor of a building, and means 11 for connecting the outlet to a source of current.

Figure 2:
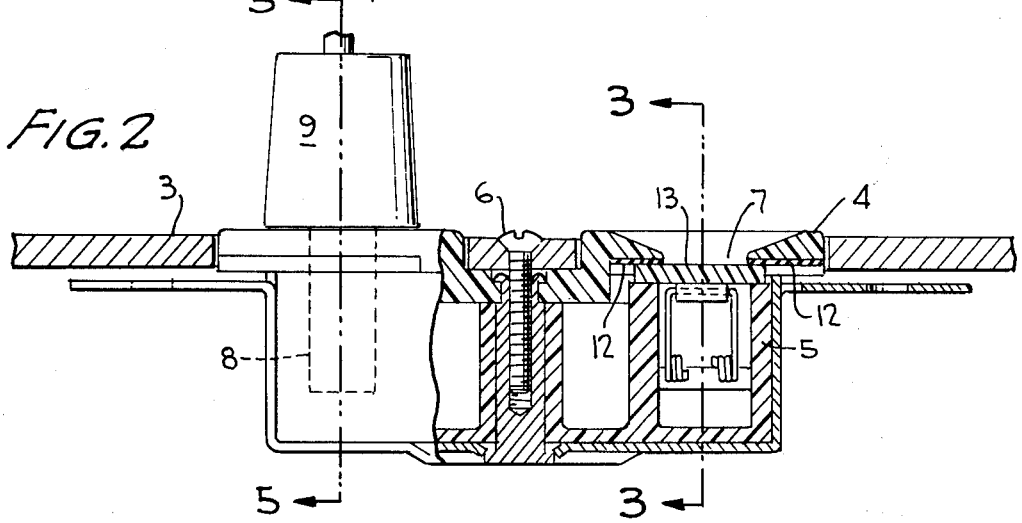
FIG. 2 is a side partial sectional view along section line 2 — 2 in FIG. 1 illustrating the assembled outlet with a plug inserted in one of the receptacles. The outlet is provided with a face plate and a gasket means.

Referring to FIG. 2, outlet 1 is covered by a cover plate 3 of the conventional type. That is, the plate is of a shape and size conforming to the outline of the housing body and is made of a similar material. The outlet is comprised of a housing having upper and lower sections 4 and 5 respectively. The housing can be fabricated from any suitable non-conducting material, and is preferably molded from a plastic or resin material such as phenolics, urea/formaldehyde, carbonates, engineering plastics such as Celcon and Delrin and the like. In a preferred embodiment, the upper and lower housing sections are each a single molded piece.

The upper and lower housing sections 4 and 5 are connected together by suitable connecting means 6, to form a unitary structure. Suitable connecting means can be a metal rivet, or a screw, a plastic interlocking means or a type of adhesive or bonding material.

The upper section of the housing is provided with the usual slots 7 to receive the prongs 8 of plug 9 as shown by the broken line.

Referring to FIG. 1, it is apparent that each outlet slot 7 and 7' is rectangular in cross-section so as to receive the similarly shaped prongs of a conventional plug. Most conventional plugs have prongs which are substantially rectangular in cross-section, either in the form of a solid bar or in the form of a reversely bent contact element. However, the slots if desired, may be of any other shape in cross-section to receive the prongs of plugs having similar cross-sectional shapes.

Referring to FIG. 2, a gasket 12 is positioned between shutter means 13 and upper housing 4. Although the gasket is optional, it is a preferred embodiment since it provides the outlet with a water-proof capability. The gasket can be made of conventional gasket materials including rubber, silicone, and various plastics and natural fiber materials such as cork.

Referring to FIG. 3, electrical contact means 10 and 10' are positioned in the lower housing section 5. The electrical contact is made of an electrically conductive material and is provided with means 11 for connecting the outlet to a source of current.

SHUTTER MEANS

Referring to FIG. 3 when the safety feature of the invention is in the normally closed position, shutter means 13 and 13' are biased against slots 7 and 7'. In FIGS. 14, 16, and 19 the shutter means is designated 30 and 30'. When these various shutters means are in the closed position, they prevent contaminants such as dirt, dust, water, and the like from entering through slots 7 and 7' and depositing on the surfaces of contacts 10 and 10'. This feature of the invention in combination with the post-assembly break joint 16 provides a distinct advantage over conventional outlets particularly when one considers the extended delay and opportunity for contamination between manufacture and installation of the outlet. These features assure the consumer of installing a "fresh" outlet.

Shutter means 13 and 13' and 30 and 30' are preferably molded from conventional plastic materials such as phenolics, urea/formaldehyde derivatives, polycarbonates, engineering plastics such as Celcon and Delrin and the like.

In a preferred embodiment the shutter means are molded with a tamper proof, post-assembly break joint 16 which is shown in FIGS. 3, 4, 7, and 15. Break joint 16 provides a means of achieving high speed assembly of the shutter means while assuring alignment of the shutter means 13 and 13' with slots 7 and 7' and shutter pivoting means 14 and 14' respectively. In addition, post-assembly break joint 16 provides the outlet with a tamper proof feature which assures the consumer that the outlet as purchased has not been activated or used prior to installation. The shutter means can be modified in several ways without substantially departing from the basic operational features. Alternative configurations of the shutter means are illustrated in FIGS. 14,16,19,24 and 25.

Figure 7:
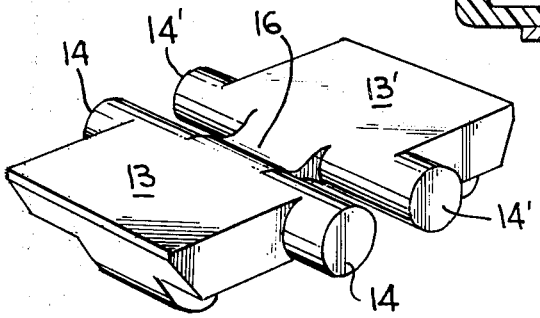
FIG. 7 is a perspective view of the shutter means of FIGS. 1-6 illustrating one of the positioning and post assembly break joint embodiments.

Referring to FIG. 4, shutter means 13 and 13' are provided with shutter positioning means 14 and 14' which in this embodiment are shown as shafts integral with the shutters and rotatably mounted in bearing means 15 and 15' provided in lower housing 5. The shutter positioning means allow the shutter means to be rotated inward through an arc of up to 90° as illustrated in FIGS. 5 and 6, when plug prongs 8 and 8' simultaneously enter slots 7 and 7' and engage the shutter means. This shutter positioning means is also illustrated in FIG. 7. Alternative shutter positioning means are illustrated in FIGS. 14,16 and 19.

Referring to FIG. 4, bearings 15 and 15' are preferably designed to provide for interclearance of shutter means 13 and 13' when they are separated along break joint 16. This interclearance is provided by sufficient tolerance between bearing 15 and 15' and shutter positioning means 14 and 14' such that when the shutters are separated, synchronizer 17 can spread the shutter means sufficiently to provide clearance to the shutter means can pivot inwardly free from interference at the break joint. This interclearance feature is illustrated in FIGS. 5 and 6.

Referring to FIG. 4, when manufacturing the electrical outlet of the invention, the lower housing 5 can be molded by means of a simple molding step which provides the bearing means 15 and 15' required for shutter positioning; support means for the electrical contacts 10, and lock means for guiding the synchronizer. The electrical contacts 10 are inserted into the lower housing. The shutter means 13 and 13' provided with post-assembly break joint 16, shutter positioning means 14 and 14' and synchronizer 17 pre-assembled, are positioned in bearings 15 and 15'.

Referring to FIG. 2, upper housing 4 is secured to lower housing 5 by securing means 6 to provide a unitary structure with the shutter means positioned in the closed position. Thus, the two sections of the housing and the various working parts housed therein are effectively retained and secured in assembled relationship. It can be appreciated that the outlet described herein may be assembled quickly by unskilled workers which contributes greatly to the low cost of production of the outlet.

Referring to FIGS. 5, 6, 12, 17, 20 and 22 it is apparent that the simultaneous insertion of plug prongs 8 and 8' into slots 7 and 7' respectively moves shutter means 13 and 13' inwardly. FIGS. 5 and 6 illustrate the separation of shutters 13 and 13' along break joint 16 with sufficient interclearance to allow pivoting of the shutter inwardly in the general direction of the prong travel.

SYNCHRONIZER MEANS / LOCK MEANS

Figure 9:
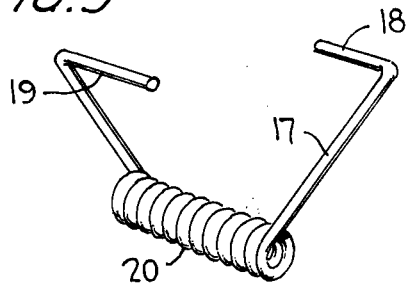
FIG. 9 is a perspective view of a preferred wire form, spring, synchronizer means.

As illustrated in FIGS. 3, 5, 6, 12, and 13, synchronizer 17 is generally V or U shaped and is provided with biasing points 18 and 19 which engage shutter means 13 and 13' respectively, generally inward of shutter positioning means 14 and 14' respectively. Integral with the biasing points of the synchronizer means is lock pall 20 which is responsive to the biasing points. The synchronizer can be fabricated as a wire form spring as shown in FIGS. 2, 3, 4, 5, 6, 8, 9, 14, 15, 16, 17, 18, 19, 20, 21, 22, 23, and 25 and illustrated in detail in FIG. 9, or alternatively the synchronizer can be fabricated as a metal stamped spring as shown in FIGS. 10, 11, 12, and 13 or alternatively the synchronizer can be fabricated as a plastic spring, as illustrated in FIGS. 26 and 28.

Referring to FIGS. 3, 10, 14, 16, 19, 21 and 23 when the safety feature of the invention is in the normally closed position synchronizer 17 biases the shutter means against slots 7 and 7' with the lock pall 20 positioned substantially equi-distant between contacts 10 and 10' and free from and substantially outward from the lock means generally designated as 21. Lock means 21 is comprised of a lock detent means 22 which is positioned substantially directly inward from said shutter pivoting means 14 and 14'; and a lock travel means 23 which is positioned inward of and in communication with the lock detent means. Alternative lock means and a lock post means are illustrated in FIGS. 10, 11, 12, and 13. Referring to FIGS. 5, 6, 12, 17 and 22 when plug prongs 8 and 8' enter slots 7 and 7' they engage shutters 13 and 13' simultaneously, pivoting the shutters inwardly via shutter positioning means 14 and 14' respectively. The biasing points 18 and 19 of synchronizer 17 respond to this simultaneous force in conjunction with lock pall 20 by biasing inward causing lock pall 20 to travel past lock detent means 22 and into lock travel means 23. When the prongs are inserted, shutter means 13 and 13' cause a wiping action on one surface of the prongs. It can be appreciated that depending upon the location of the shutters, various surfaces of the prongs can be wiped. For example, the shutters could be positioned to wipe those surfaces of the prongs which engage contacts 10 and 10' to assure a better electrical engagement. This alternative is illustrated in FIG. 22. In one embodiment of the invention the shutter means surface can be provided with a suitable abrasive in order to achieve an abrading of the prong surface prior to and after engaging contacts 10 and 10'. Obviously the shutter means can be positioned so that any of the various surfaces of the prongs can be wiped and/or abraded. It will be further appreciated that the wiping action of the shutters illustrated in FIGS. 5, 6, 17, 20, and 22 also functions as an arc depressant or arc deflector.

Referring to FIGS. 6, 12, 17, 20 and 22 upon engagement of prongs 8 and 8' with contacts 10 and 10' the shutter means are biased against the surface of the prongs thereby assuring optimum electrical engagement of the prongs with the contacts. Upon withdrawal of the plug prongs the shutter means pivot outward and return to the normally closed position as shown in FIG. 2, 3, 11, 14, 16, 19 and 21.

FIGS. 8, 11, and 18 illustrate the safety feature of the invention. That is, when a foreign object 24, is pushed through slot 7 and engages shutter 13, shutter 13 pivots inwardly via shutter positioning means 14. Since shutters 13 and 13' are interdependent and shutter 13' has not been engaged, synchronizer 17 responds to the single force applied at 13 by lock pall means 20 engaging lock detent means 22 restricting further inward movement of shutter 13.

Referring to FIGS. 10, 11, and 12, an alternative embodiment for the synchronizer and lock means is illustrated wherein lock pall 20 of synchronizer 17 is in continuous engagement with lock means 21. Upon simultaneous engagement of the shutter means, lock pall 20 travels past lock detent means 22 onto lock travel post means 23. In addition, the engagement of biasing points 18 and 19 with shutter means 13 and 13' respectively is slightly modified from that shown in FIG. 3. This method of engagement is particularly suited for post-assembly insertion of the synchronizer. That is, once the shutter means have been inserted in the bearing means the synchronizer can be biased and inserted into the housing to engage the shutter means. FIG. 13 illustrates the synchronizer and lock means unassembled.

POSITIONING MEANS

FIG. 7 illustrates the positioning means 14 and 14' for shutter means 13 and 13'. It can be appreciated from FIGS. 3, 4, 5, and 6 that these means 14 and 14' are fixed and provide a rotational movement to shutter means 13 and 13'. In FIGS. 5 and 6 these positioning means allow the shutter means to pivot inward through an arc of up to 90°. Alternative positioning means for obtaining the inward movement of shutter means 13 and 13' are illustrated in FIGS. 14, 19, and 20.

In FIGS. 14, 19 and 20, shutter means 30 and 30' are located within positioning means 31 and 31' respectively and are fixed to synchronizer 17 by means of biasing points 18 and 19. Shutter means 30 and 30' are biased against slots 7 and 7' and upon simultaneous insertion of plug prongs 8 and 8' move inwardly by sliding on positioning means 30 and 30' respectively. Thus, positioning means 30 and 30' in cooperation with that portion of the upper housing indicated at 32 and 33 respectively guide the inward movement of the shutter means with no need for a fixed positioning means.

FIG. 15 is an exploded view of the shutter means 30 and 31 illustrating the post-assembly break joint 16 and biasing points 18 and 19.

FIGS. 24 and 25 illustrate another alternative positioning means for shutter means 13 and 13', in the form of coaxial pivot means, comprising shaft means 34 and housing means 35. Upon biasing of synchronizer 17 the shutters 13 and 13' pivot by means of coaxial pivot means 33.

FIG. 23 illustrates a portable outlet such as an extension cord 24 provided with the upper and lower housings 25 and 26 respectively, slots 7 and 7', shutter means 13 and 13', shutter positioning means 14 and 14', synchronizer 17, lock pall 20, lock detent means 22 and lock travel means 23.

The biasing of shutters 13 and 13' against slots 7 and 7' by synchronizer 17 is a particularly advantageous feature of this embodiment of the invention because of the propensity small children have to place outlets such as these in their mouths. When the outlet is provided with a gasket means, 12, it is virtually impossible for a small child to receive a burn due to saliva reaching electrical contact means 10 and 10'.

FIGS. 26, 27 and 28 illustrate the safety feature of the invention as a one-piece assembly provided with alternative post assembly break joint means. FIG. 26, illustrates the one piece assembly as molded. That is, shutter means, means 13 and 13', and positioning means 14 and 14' are connected to synchronizer 17 during the one-piece molding operation at biasing points 18 and 19 by alternative post assembly break joint means 36 and 37 respectively.

FIG. 27 illustrates the intact one-piece assembly about to be inserted into the housing, that is, after synchronizer means 17 has been biased and lock pall means 20 has been more definitely defined. It is noted that the post assembly break joint means 36 and 37 remain intact.

FIG. 28 illustrates separation of synchronizer 17 from biasing points 18 and 19 at post assembly break joints 36 and 37. This separation will generally occur upon insertion of the plug prongs for the first time.

It has been found that a one-piece molded assembly such as illustrated in FIGS. 26, 27 and 28 is one of the most economical embodiments of the invention. For example, the assembly of the one-piece into the housing can be achieved at high speed with little capital investment in equipment. Secondly, the plastic synchronizer which is preferably molded from an engineering plastic such as a polycarbonate has been found to be substantially cheaper than a correspondng metal synchronizer means.

As noted above, the various structural insulating elements of the present invention may be manufactured from any suitable insulating material known in the art, for example, plastics, resins and porcelain, or the like. However, when the safety feature of the invention is to be used in various extension cords and other mobile electrical outlets, the insulating materials are preferably produced from a substantially resilient insulating material, such as rubber.

Without further analysis, the foregoing will so fully reveal the gist of the invention that others can, by applying current knowledge, readily adapt it for various applications without omitting features that, from the standpoint of prior art, fairly constitute essential characteristics of the generic and specific aspects of this invention and, therefore, such adaptations should and are intended to be comprehended within the meaning and range of equivalence of this invention, as defined by the appended claims.

I claim:

1. An electrical outlet comprising:

1. a housing including face means; slots in said housing face means suitable for receiving the prongs of an electrical plug, electrical contacts supported in said housing positioned inward of said slots and suitable for engaging said prongs;

2. two interdependent, shutter means having flat contact surfaces for said prongs parallel to said housing face means containing said slots, each of said shutter means being biased against one of said slots; stationary shutter positioning means provided within said housing adjacent to said slots for securing each of the shutter means about a fixed point whereby said shutter means can be pivoted and rotated inward about said fixed point while being prevented from other movement;

3. a synchronizer means provided with: (a) biasing means directly rotationally engaging said shutter means, and (b) a lock pall means responsive to said biasing means; and

4. a lock means, positioned inward of said synchronizer supported within said housing substantially equidistant between said contacts comprising: (a) a lock detent means positioned substantially directly inward from said shutter positioning means whereby engagement with the lock pall restricts the inward movement of either shutter means, (b) a lock travel means located inward of and in communication with said lock detent means which provides travel for said synchronizer means when the shutter means are engaged simultaneously.

2. An outlet according to claim 1 whereby insertion of a plug into said slots:

a. engages each of the shutter means simultaneously, b. moves the shutter inwardly with a corresponding movement of the lock pall means along the lock travel means, and c. engages each of said contacts with a biasing of said shutters against the prongs.

3. An outlet according to claim 1 wherein the shutter means is positioned in the housing such that the surfaces of the plug prongs which engage the outlet contacts are wiped by the shutter means prior to engagement with the contacts.

4. An outlet according to claim 1 wherein the shutter means are biased against the prongs upon engagement with the contacts.

5. An outlet according to claim 1 wherein the shutter means is provided with a tamper-proof, post-assembly, break joint.

6. An outlet according to claim 1 wherein the synchronizer is provided with two biasing points each of which engages one of said shutter means inward of said shutter positioning means.

7. An outlet according to claim 1 wherein the synchronizer is a wire form metal spring.

8. An outlet according to claim 1 wherein the synchronizer is a stamped metal spring.

9. An outlet according to claim 1 wherein the shutter means, shutter positioning means, synchronizer means, and lock means are molded in one-piece.

10. An outlet according to claim 1 wherein the lock pall means is integral with the biasing points.

11. An outlet according to claim 1 wherein the synchronizer is in contact with the lock means in the closed and open positions.

12. An outlet according to claim 1 wherein a gasket means is provided between the shutter means and the slots.

13. An outlet according to claim 1 wherein the shutter positioning means comprises a shaft rotably mounted on a bearing means provided within the house.

14. An outlet according to claim 13 wherein the bearing means within the housing provides for interclearance of the shutter means upon separation of the shutter means at a break joint.

* * * * *